United States Patent [19]

Holtz

[11] 4,345,346

[45] Aug. 24, 1982

[54] HEAD SUPPORT

[76] Inventor: Leonard Holtz, 418 Jordan St., Oceanside, N.Y. 11572

[21] Appl. No.: 211,841

[22] Filed: Dec. 1, 1980

Related U.S. Application Data

[62] Division of Ser. No. 151,908, May 21, 1980.

[51] Int. Cl.[3] ..... A47G 9/00

[52] U.S. Cl. ..... 5/437

[58] Field of Search ..... 5/431, 434, 436, 437, 5/441, 442, 465, 455; 297/391, 397

[56] References Cited

U.S. PATENT DOCUMENTS

| | | | |
|---|---|---|---|
| 716,752 | 12/1902 | Phillips | 5/455 |
| 3,052,891 | 9/1962 | Panepinto | 2/326 |
| 3,092,848 | 6/1963 | Gronvold | 5/495 |
| 4,274,673 | 6/1981 | Kifferstein | 5/437 |

*Primary Examiner*—Alexander Grosz

*Attorney, Agent, or Firm*—Frishauf, Holtz, Goodman and Woodward

[57] ABSTRACT

A head support for use on airplanes, buses and the like comprises a pair of pillows and an interconnecting member connecting the pillows with a spacing therebetween. Two interconnecting members may be provided. The interconnecting member is preferably releasably connected to the pillows and may be elastic or non-elastic.

6 Claims, 8 Drawing Figures

HEAD SUPPORT

This is a division of application Ser. No. 151,908 filed May 21, 1980.

BACKGROUND OF THE INVENTION

This invention relates to a head support, and more particularly to a head support which is particularly useful for travelers in airplanes, trains, buses, etc.

Seats in airplanes, trains, buses and the like generally have high backs for supporting the head of a traveler. However, there is no lateral or side-to-side support and if the traveler falls asleep, his head generally falls over to one side, causing neck pains.

The object of this invention is to provide a head support arrangement which is particularly adaptable for use in airplanes, buses, trains or the like.

A further object is to provide a head support arrangement which can utilize the standard-type pillows generally provided on airlines, trains, etc.

SUMMARY OF THE INVENTION

In accordance with the present invention, a head support arrangement comprises a pair of pillows or the like and an interconnecting member connecting the pillows with a spacing therebetween. In a preferred arrangement, the spacing is on the order of only a few inches. The interconnecting member may be elastic or non-elastic, and the interconnecting member is preferably connected to the pillows by means of releasable clasps, or the like.

In a further arrangement, two of the interconnecting devices are provided at spaced positions along the length of the pillows.

DETAILED DESCRIPTION

Figure 1:
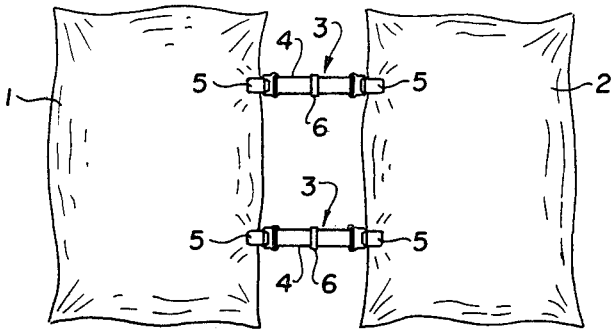
FIG. 1 is a front view of an embodiment of the present invention.
Figure 2:
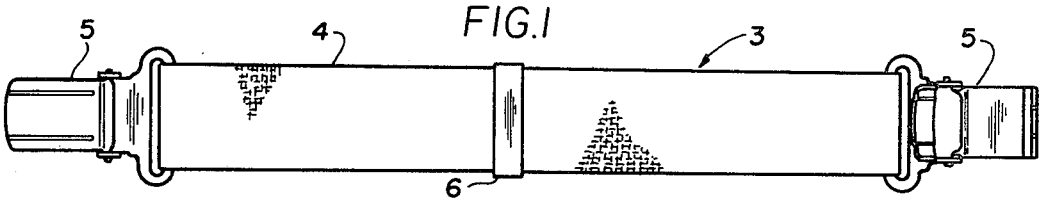
FIG. 2 is a front view of an interconnecting member for use in the present invention.
Figure 3:
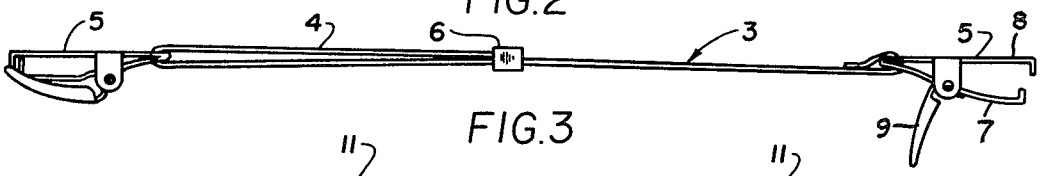
FIG. 3 is a top sectional view of the interconnecting device of FIG. 2.

Referring to FIGS. 1–3, a head support arrangement of the present invention comprises a pair of pillows 1,2 with at least one interconnecting means 3 coupling the pillows together with a spacing therebetween. The pillows may be a standard type of stuffed pillow found, for example on airlines, or may be an inflatable pillow or any other suitably shaped cushioning device. The head support arrangement comprises at least one interconnecting device 3. However, two interconnecting devices 3 may be provided at spaced positions along the length of the pillows, for example as illustrated in FIG. 1. It has been found that it is preferable to have the interconnecting devices located adjacent the upper end and adjacent the lower end of the pillows to insure that the interconnecting device does not interfere with the head of the user. If only one interconnecting device is used, it may be placed any where along the length of the pillow. It has been found in use that even if a single interconnecting device is connected to the pillows at the upper end or even at the lower end, satisfactory lateral or side support of a head is obtained.

FIG. 2 illustrates the connecting device 3 in greater detail. The connecting device 3 comprises a strap member 4 which may be resilient or non-resilient, but which is preferably flexible. In a preferred embodiment, the strap member 4 is made of an elastic-type material. At the opposite ends of the strap member 4 are releasable clasps 5 of the type generally used, for example, in suspenders. The clasps 5 are made of springy metal (or plastic), elements 7, 8 thereof being normally sprung away from each other. Elements 7, 8 are closed by L-shaped clamp member 9 as shown on the left side of FIG. 3. The strap member 4 has an adjustment mechanism 6 to adjust the length thereof, thereby adjusting the spacing between the pillows for maximum comfort.

In use, the head support arrangement is located just above the shoulders of the user, so that the head of the user may be placed in the vicinity of the spacing between the pillows. The pillows accordingly lie laterally of the head of the user and provide lateral or side support to prevent the user's head from falling off to the side, as is common in conventional airplane, train and bus seats.

Figure 4:
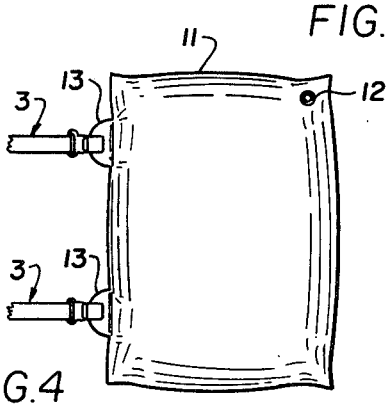
FIG. 4 is a modified arrangement of the present invention.
Figure 5:
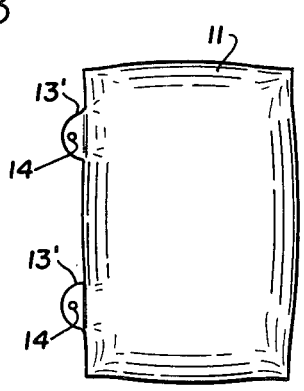
FIG. 5 illustrates a further modified arrangement of the present invention.
Figure 6:
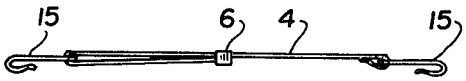
FIG. 6 illustrates a modified connecting member of the present invention.

FIG. 4 illustrates a modified arrangement of the present invention comprising a pillow-like member 11 which is inflatable by means of a conventional valve 12, the details of which are not discussed herein. The pillow-like member 11 has tabs 13 extending therefrom which may be, for example, flat members extending from an edge of the pillow 11. The interconnecting members 3 are connectable to the tabs 13, as generally illustrated in FIG. 4. The interconnecting members 3 may be as shown in FIGS. 2 and 3, or any other suitable equivalent device. In a modified arrangement, as shown in FIG. 5, the tabs 13' have apertures 14 therein to receive a hook-like member at the end of the interconnecting member. A typical interconnecting member with hook-like members 15 at the ends thereof is shown in FIG. 6. The interconnecting member shown in FIG. 6 comprises an adjusting means 6 similar to that shown in FIG. 3. The portion 4 is preferably a flexible web-like member, as shown in FIG. 2, and is preferably a resilient elastic material.

Figure 7:
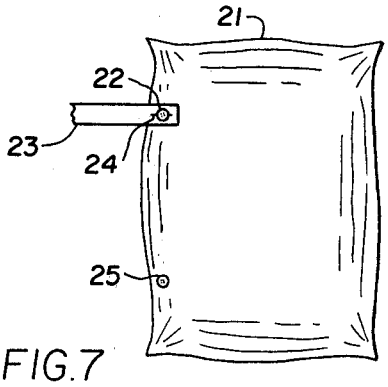
FIG. 7 illustrates a further embodiment of the invention.

FIG. 7 illustrates a pillow 21 with a button-like member 22 connected thereto. The connecting member 23 has a buttonhole 24 therein for connection to the button-like member 22. Only one pillow 24 therein for connection to the button-like member 22. Only one pillow 21 is shown in FIG. 7 for convenience, but it is clear that the head support arrangement comprises two pillows, as shown in FIG. 1. The pillow 21 has a second button-like member 25 for connection with a second connecting member 23, if desired.

Figure 8:
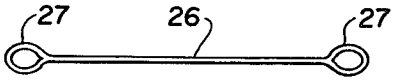
FIG. 8 illustrates another connecting device according to the present invention.

FIG. 8 illustrates a modified connecting member 26 having loops 27 at the opposite ends thereof for connection to the button-like members 22 of the arrangement of FIG. 7. The connecting member 26 of FIG. 8 may be made of strand-type material and may be of fixed length, elastic or of adjustable length, as may be the web-like adjusting member 23 of FIG. 7. The loops 27 may be integral with the connecting member 26 and may be made of flexible material, or they may comprise rigid ring-like devices connected with the flexible member 26.

I claim:

1. A method for supporting the head of a person and for preventing the head of the person from falling to the side while the person is seated, comprising:

providing a pair of individual, separable, pillows, each pillow having an edge surrounding the periphery thereof which includes at least one substantially straight elongated peripheral edge, said pillows being dimensioned to extend from the shoulders to above the head of a user;

interconnecting said pair of individual, separable, pillows along said at least one substantially straight elongated edge of each of said pillows so that said pillows are spaced from each other by means of at least one connecting member having quick releasable means at the respective opposite ends thereof, each quick releasable means of said at least one connecting member being releasably connected to a small portion of said substantially straight elongated edge of a respective pillow so as to extend between said substantially straight elongated edges and to connect the individual pillows together with said spacing between opposing substantially straight elongated edges of the respective pillows, said small portion of said substantially straight elongated edges being substantially smaller than the lengths of said substantially straight elongated edges of said pillows; and locating said interconnected, spaced pillows behind the head of the seated person with the person' head in the vicinity of the spacing between the pillows, with the pillows resting on the shoulders of the seated person and with said connecting member located behind but out of contact with the head of the user when the head of the user is placed on the pillows in the vicinity of said spacing between the pillows, the pillows being located such that the head of the user contacts the pillows in the vicinity of the central portion of said substantially straight elongated edge portions of the pillows;

said at least one connecting member being substantially thinner in the direction perpendicular to the lengthwise direction thereof than the length of said substantially straight elongated edges of said pillows being connected together so that the pillows have free, unconnected opposing substantially straight elongated edge portions over a central major portion of said substantially straight elongated edges where the head of the user is placed on said pillows such that the user's head does not contact a connecting means, whereby the pillows provide lateral or side support to the head of the user without utilizing any means extending around to the front of the neck or head of the user, and said at least one connecting member being substantially small relative to the pillows and quickly releasable from the pillows without damaging the pillows to permit quick and easy separation of the pillows from each other after use.

2. The method of claim 1, comprising interconnecting said pillows with at least two of said connecting members, each being substantially thinner in the direction perpendicular to the lengthwise direction thereof than the length of said substantially straight elongated edges of said pillows being connected together, said connecting members being connected to said pillows at respective opposite end portions of said substantially straight elongated edges of said pillows to provide said free, unconnected central major portion of said substantially straight elongated edges.

3. The method of claim 1 or 2, wherein said quick releasable means is a clasp means.

4. The method of claim 1 or 2, wherein said connecting member comprises a resilient elastic member so that said pillows are resiliently and elastically connected together.

5. The method of claim 1 or 2, wherein said connecting member is of variable length to adjust the spacing between said pillows.

6. The method of claim 1 or 2, wherein said connecting member comprises an elongated flexible member having said quick releaseable means at the respective opposite ends thereof.

* * * * *